US007581526B2

(12) United States Patent
Lehmann

(10) Patent No.: US 7,581,526 B2
(45) Date of Patent: Sep. 1, 2009

(54) DEVICE AND METHOD TO INCREASE FUEL BURN EFFICIENCY IN INTERNAL COMBUSTION ENGINES

(75) Inventor: Harry V. Lehmann, 4 Vineyard Ct., Novato, CA (US) 94947

(73) Assignee: Harry V. Lehmann, Novato, CA (US)

( * ) Notice: Subject to any disclaimer, the term of this patent is extended or adjusted under 35 U.S.C. 154(b) by 0 days.

(21) Appl. No.: 11/498,766

(22) Filed: Aug. 4, 2006

(65) Prior Publication Data

US 2007/0044755 A1 Mar. 1, 2007

Related U.S. Application Data

(60) Provisional application No. 60/712,840, filed on Sep. 1, 2005.

(51) Int. Cl.
*F02F 3/24* (2006.01)

(52) U.S. Cl. ..... 123/269; 123/307; 123/661

(58) Field of Classification Search ..... 123/269, 123/279, 285, 298, 307, 193.6, 661
See application file for complete search history.

(56) References Cited

U.S. PATENT DOCUMENTS 1,741,032 A * 12/1929 Minter ..... 123/657
1,745,884 A 2/1930 Barnaby
1,754,735 A 4/1930 Barnaby
1,805,670 A * 5/1931 Miller ..... 123/65 VC
2,151,218 A 3/1939 Lutz
2,231,392 A 2/1941 McCarthy
2,269,084 A * 1/1942 McCarthy ..... 123/298
2,815,014 A * 12/1957 Adams ..... 123/660
3,919,982 A * 11/1975 Goto et al. ..... 123/295
4,280,459 A 7/1981 Nakanishi
4,357,915 A 11/1982 Monsour
4,359,027 A 11/1982 Scharpf
4,389,986 A * 6/1983 Tanasawa ..... 123/298
4,471,734 A 9/1984 Showalter
4,572,123 A 2/1986 Evans
4,617,888 A * 10/1986 Dent ..... 123/307
4,663,938 A * 5/1987 Colgate ..... 60/620
4,669,431 A 6/1987 Simay (Continued)

FOREIGN PATENT DOCUMENTS

JP 56129716 10/1981

(Continued)

OTHER PUBLICATIONS

Takeshi Hashizume, et al, Combustion Chamber For Diesel Engine, Jan. 13, 1998.*

*Primary Examiner*—Hai H Huynh
(74) *Attorney, Agent, or Firm*—Duane Morris LLP

(57) ABSTRACT

A reciprocating piston engine wherein the movement of a piston within the combustion chamber creates vortices in the fluid within the chamber and wherein the orientation of the vortices is more normal to the axis of movement of the piston than parallel to the axis of movement of the piston. The vortices may be created by a device for attachment to the crown of a piston or by the configuration of the crown of the piston. The vortices may be created by a plurality of vanes extending outwardly from the center of the piston to the periphery thereof.

36 Claims, 7 Drawing Sheets

U.S. PATENT DOCUMENTS

| | | | | |
|---|---|---|---|---|
| 4,898,135 | A | 2/1990 | Failla et al. | |
| 4,977,874 | A * | 12/1990 | Ongetta | 123/269 |
| 5,000,136 | A | 3/1991 | Hansen et al. | |
| 5,065,715 | A | 11/1991 | Evans | |
| 5,103,784 | A | 4/1992 | Evans | |
| 5,224,449 | A | 7/1993 | Furkano et al. | |
| 5,322,042 | A | 6/1994 | di Priolo et al. | |
| 5,425,337 | A | 6/1995 | Matsuoka | |
| 6,047,592 | A | 4/2000 | Wirth et al. | |
| 6,170,454 | B1 * | 1/2001 | McFarland et al. | 123/193.6 |
| 6,178,942 | B1 | 1/2001 | di Priolo et al. | |
| 6,237,579 | B1 | 5/2001 | Singh | |
| 6,341,591 | B1 * | 1/2002 | Tsutsumi et al. | 123/295 |
| 6,360,715 | B1 * | 3/2002 | Stromberg et al. | 123/301 |
| RE37,714 | E | 5/2002 | Ueda et al. | |
| 6,609,490 | B2 * | 8/2003 | Flinchbaugh et al. | 123/193.6 |
| 6,615,789 | B2 * | 9/2003 | Inoue et al. | 123/193.6 |
| 6,708,666 | B2 * | 3/2004 | Roberts, Jr. | 123/256 |
| 6,729,290 | B1 | 5/2004 | Rorke | |
| 7,353,797 | B1 * | 4/2008 | Breidenthal | 123/279 |
| 2008/0135016 | A1 * | 6/2008 | Ashizawa et al. | 123/301 |
| 2008/0276900 | A1 * | 11/2008 | Umierski et al. | 123/193.6 |
| 2009/0038594 | A1 * | 2/2009 | Naquin | 123/661 |

FOREIGN PATENT DOCUMENTS

| | | | |
|---|---|---|---|
| JP | 58107812 | | 6/1983 |
| JP | 10-8965 | * | 1/1998 |
| JP | 11-8206 | * | 3/1999 |

* cited by examiner

DEVICE AND METHOD TO INCREASE FUEL BURN EFFICIENCY IN INTERNAL COMBUSTION ENGINES

RELATED APPLICATIONS

This application is related to and claims the priority of U.S. Provisional Patent Application Ser. No. 60/712,840 entitled "Device to Increase Fuel Burn Efficiency in Gasoline and Diesel Piston Engines," filed Sep. 1, 2005, the disclosure of which is incorporated herein by reference.

BACKGROUND OF THE DISCLOSURE

The present disclosure relates to a system and method for increasing the efficiency of fuel burn in internal combustion piston engines by enhancing the level of turbulence in the fuel-air mixture before and after an ignition event.

Internal combustion engines produce mechanical power from the chemical energy contained in hydrocarbon fuel. Internal combustion engines depend upon the process of combustion: the reaction of a fuel, typically with air, although other oxidizers such as nitrous oxide may be employed. As such, the amount of energy or power released from the fuel is a function of the degree of oxidation and, therefore, is consequently dependent on the amount of oxygen available to the fuel during combustion. It is presently understood that as a general principle, the greater the degree of oxidation saturation of the fuel-air mixture, the higher the efficiency of the engine (reflected for example in the gas mileage of an automobile) and the greater the power output of the engine (reflected for example in horsepower).

The most common fuels in use today comprise hydrocarbons and are derived from petroleum. These include the fuels known as diesel, gasoline and liquefied petroleum gas. Most internal combustion engines designed for gasoline may operate on natural gas or liquefied petroleum gases without modifications except for the associated fuel delivery components. Liquid and gaseous biofuels, such as Ethanol may also be used. Some engines may run on hydrogen, however this can be dangerous, and modifications to the cylinder block, cylinder head, and head gasket are required to contain the flame front.

Combustion of hydrocarbon fuels in internal combustion engines has been found to produce several major pollutants including: oxides of nitrogen ($NO_X$); oxides of carbon (CO, $CO_2$); hydrocarbons (HC); and other pollutants subject to oxidation. Carbon dioxide ($CO_2$) is generally considered a non-toxic necessary by-product of the hydrocarbon oxidation process. With respect to carbon monoxide (CO) and hydrocarbon emissions it is understood that increased oxidation during combustion tends to reduce the formation of these compounds by way of oxidation. With respect to $NO_X$ emissions, their formation is understood to be largely a function of combustion temperatures. However, it is also presently understood that improved mixing of the fuel and air may tend to reduce $NO_X$ formation. In order to reduce the emissions from internal combustion engines directly to the environment, catalytic converters have been employed. Catalytic converters, however, are costly and their effectiveness over time weakens requiring inspection and replacement to maintain performance. Further, the life span of catalytic converters is understood to be a function of the amount of pollutants (primarily unburned hydrocarbons) that the converter has processed. Accordingly, in addition to increasing the efficiency and power output of the internal combustion engine, increased oxidation and saturation of the fuel-air mixture during combustion is also likely to increase the life span of the catalytic converter.

Internal combustion engines require a means of ignition to promote combustion. Most engines use either an electrical or a compression heating ignition system. Electrical ignition systems generally rely on a lead-acid battery and an induction coil to provide a high voltage electrical spark to ignite the air-fuel mix in the engine's cylinders. Compression heating ignition systems, such as diesel engines, rely on the heat created in the air by compression in the engine's cylinders to ignite the fuel. Once successfully ignited and burned, the combustion products, hot gases, have more available energy than the original compressed fuel-air mixture (which had higher chemical energy). The available energy is manifested as high temperature and pressure which may be translated into work by the engine.

Reciprocating and rotary engines comprise two categories of positive displacement engines that are traditionally employed to power motor vehicles. In general, a positive displacement internal combustion engine is an engine in which the flow of the fuel-air mixture is segmented into distinct volumes that are completely isolated by solid sealing elements throughout the engine cycle, creating compression and expansion through the physical volume changes within the chamber. Of the two engines, the reciprocating engine is by far the more common.

Reciprocating engines incorporate a piston that travels back and forth in a chamber formed in the engine block and transmits power through a connecting rod and crank mechanism to the drive shaft of a vehicle. Typically the chamber is cylindrical and is often referred to as a cylinder. A majority of reciprocating engines work on what is known as a four-stroke cycle. That is, each cylinder of the engine requires four-strokes of its piston or two revolutions of the crankshaft to complete the sequence of events which produces one power stroke. The first stroke is termed an intake stroke starting with the piston at top center crank position and ending with the piston at the bottom center crank position. As the piston moves from the top to the bottom center crank position, a fresh intake mixture generally comprised of air or air and fuel is drawn into the cylinder through an inlet valve, which typically opens just before the stroke starts and closes shortly after it ends. Whether the intake mixture drawn into the cylinder is comprised of air or air and fuel is dependent on the type of engine. For example, in a typical spark ignition engine, air passes through an air filter and then is mixed with fuel in the intake system prior to entry to the engine using a carburetor or fuel injection system. The fuel-air mixture is then drawn into the cylinder via the intake valve during the intake stroke. In comparison, a compression ignition engine inducts air alone into the cylinder during the intake stroke and the fuel is directly injected into the engine cylinder just before combustion.

FIG. 1 is an illustration of a common cylinder 10, piston 20 and valve configuration for a four-stroke spark ignition reciprocating engine 100 wherein the cylinder 10 is approaching bottom center crank position during an intake stroke. The inlet valve 30, through which an intake mixture 32 is drawn, is generally comprised of an elongated rod called the valve stem 34 and an integrally connected generally disc shaped surface called the valve head 35. The valve head 35 is manufactured to have a seat 36 that is adapted to mate with the internal edge surface of an orifice or port 38 located usually in the top of the cylinder 10. The outlet valve 40, through which an exhaust mixture is expelled (not shown), is also generally comprised of a valve stem 42 and an integrally connected generally disc shaped valve head 45. Additionally, for a two-stroke engine, there may simply be an exhaust outlet and fuel inlet instead of a valve system.

Increasing the efficiency of fuel burn in internal combustion engines, i.e., improving the rate of conversion of fuel into energy has long been a desirable goal. Many have addressed the issue of improving the mixture of air and fuel in the combustion chamber by increasing turbulence in the mixture during the travel of the piston in the chamber. Exemplary methods attempting to improve the fuel-air mixture include increasing chamber turbulence through the installation of grooves in the compression head of the piston (see, e.g., the Singh U.S. Pat. No. 6,237,579 and the Barnaby U.S. Pat. No. 1,745,884), installation of squish areas and vanes in the piston head (see, e.g., the Nakanishi U.S. Pat. No. 4,280,459), installation of guiding ribs on the crown of the piston (see, e.g., the Wirth U.S. Pat. No. 6,047,592), and grooving the piston crown to create a central squish area with radiating channels (see, e.g., the Evans U.S. Pat. Nos. 5,065,715, 5,103,784, and 4,572,123). The aforementioned examples, however, require significant modifications to either the piston or to the corresponding cylinder or engine and impart a cyclonic turbulence oriented and moving along the longitudinal axis of the cylinder, i.e., the thrust line of the piston (the direction of the thrust line of the piston is referred to as the "axial" direction throughout the present application).

Others such as that disclosed in the Showalter U.S. Pat. No. 4,471,734 seek to increase the efficiency of fuel burn by interrupting the symmetry of the roll-up of fuel-air mixtures occurring as a result of symmetrical cylindrical geometry. By placing uneven edges at the circumferential boundary of a piston crown, Showalter interrupts roll-up vortices aligned along the line of thrust of the piston. Still other attempts to address the issue of increasing the efficiency of fuel burn include installations of an entire piston crown having a spirally notched extension to facilitate a generally cylindrical expanding flame front over the top of the piston during a power stroke (see, e.g., the Hansen U.S. Pat. No. 5,000,136) and installation of a piston crown having both a squish area and guiding ribs thereon (see e.g., the Simay U.S. Pat. No. 4,669,431). Such examples also require significant modifications to either the piston geometry or to the engine block or head and impart a cyclonic turbulence oriented and moving in the axial direction (i.e., the sliding or reciprocating axis of the piston).

The method and device of the present subject matter, in various embodiments, provides for the highly desirable characteristics of enhancing the turbulence in the fuel-air mixture before and during the ignition event while avoiding significant modifications to either the piston geometry or to the engine block or head. Further the method and device of the present subject matter increase oxidation saturation of the fuel-air mixture by creating significant turbulence in the combustion chamber before the ignition event and during flame front propagation from that event. As distinguished from the prior art where vortices may be generated in the chamber that are aligned with the axis of movement of the piston, the devices and methods of the present disclosure creates turbulence in the combustion chamber by the generation of vortices in the fuel-air mixture having a movement that is more lateral than axial relative to the axis of movement of the piston during piston travel within the chamber. A vortex may be broadly defined as a whirling mass of air, flame, or fuel-air mixture having a tangential velocity component perpendicular with, and not intersecting the central axis thereof, i.e., forming a three-dimensional column or spiral having a generally central axis. As used herein, the orientation of a vortex is generally the direction of the central axis of the vortex (i.e., the vortex line), and a directional adjective (e.g., "radial") modifying the term "vortex" indicates the general orientation of the central axis of the vortex.

In one aspect the method and device of the present subject matter increases the efficiency of fuel burn in piston engines by enhancing the level of turbulence in the fuel-air mixture before an ignition event and increases the efficiency of the conversion of fuel energy to work by residuary influences of turbulence on the post ignition flame front. Thus, embodiments of the present subject matter promote a more rapid and complete burning of the fuel, lower engine operating temperatures, and enhanced torque and power through the range of engine operation resulting in an improved fuel economy having lower emissions, smoother operation, increased combustion pressures, and an increased engine life.

Accordingly, it is an object of the present subject matter to obviate many of the deficiencies of known internal combustion engines and to provide a novel internal combustion engine having a piston reciprocatingly slidable within a combustion chamber to compress for combustion a fluid mixture including oxygen and a combustible fuel, and to provide driving power in response to the combustion of the fluid mixture within the chamber. The surface of the piston in contact with the fluid mixture causes vortices in the fluid mixture as the piston moves axially within the cylinder and the orientation of one or more of the vortices created within the fluid mixture relative to the sliding axis of the piston is more lateral (e.g., radial in a cylindrical chamber) than axial.

It is another object of the present subject matter to provide a novel internal combustion engine having a piston reciprocatingly slidable within a combustion chamber to compress for combustion a fluid mixture including oxygen and a combustible fuel so that driving power is provided in response to the combustion of the fluid mixture within the chamber, wherein the surface of the piston in contact with the fluid mixture includes a plurality of vanes extending from the piston generally axially of the chamber and extending generally from the center of the piston outwardly toward the radial periphery thereof. In preferred embodiments, each of the vanes possess two generally axially extending walls and a connecting surface at the distal end thereof to the piston, and the slope relative to the sliding axis of the piston of one of these two walls is greater than the slope of the other of these two walls.

It is also an object of the present subject matter to provide a novel device for attachment to the crown of a piston of a reciprocating piston engine for causing vortices in the fluid contained in the combustion chamber during reciprocation of the piston in which the orientation of one or more of the vortices is more orthogonal than parallel to the reciprocating axis of the piston.

It is an additional object of the present subject matter to provide a novel device for attachment to the crown of a piston in a reciprocating piston engine, more specifically, a device having an axially central portion and a plurality of vanes extending radially outwardly from the central portion in which the slope relative to the reciprocating axis of the piston of one of the axially extending walls of the vanes is greater than the other.

It is still another object of the present subject matter to provide a novel reciprocating piston engine wherein the movement of a piston within a cylinder creates vortices in the fluid within the cylinder in which the orientation of the vortices relative to the cylinder is more radial than axial.

It is an object of the present subject matter to provide a novel piston for reciprocating in a combustion chamber for creating radial vortices of the fuel-air mixture compressed within the combustion chamber by movement of the piston axially within the chamber.

It is a further object of the present subject matter to provide a novel radial vortex generator adapted for attachment to the crown of a piston comprising a plurality of vanes extending from the crown generally axially of the piston from the radial center thereof toward the radial periphery thereof.

It is still a further object of the present subject matter to provide a novel method of generating combustion enhancing turbulence in the fluid within a combustion chamber of a reciprocating piston engine.

It is also an object of the present subject matter to provide a novel method of generating combustion enhancing turbulence in the fuel mixture in the combustion chamber of a reciprocating piston internal combustion engine by creating vortices in the fuel air mixture in which the orientation of one or more of the vortices relative to the reciprocating axis of the piston is more lateral than axial.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
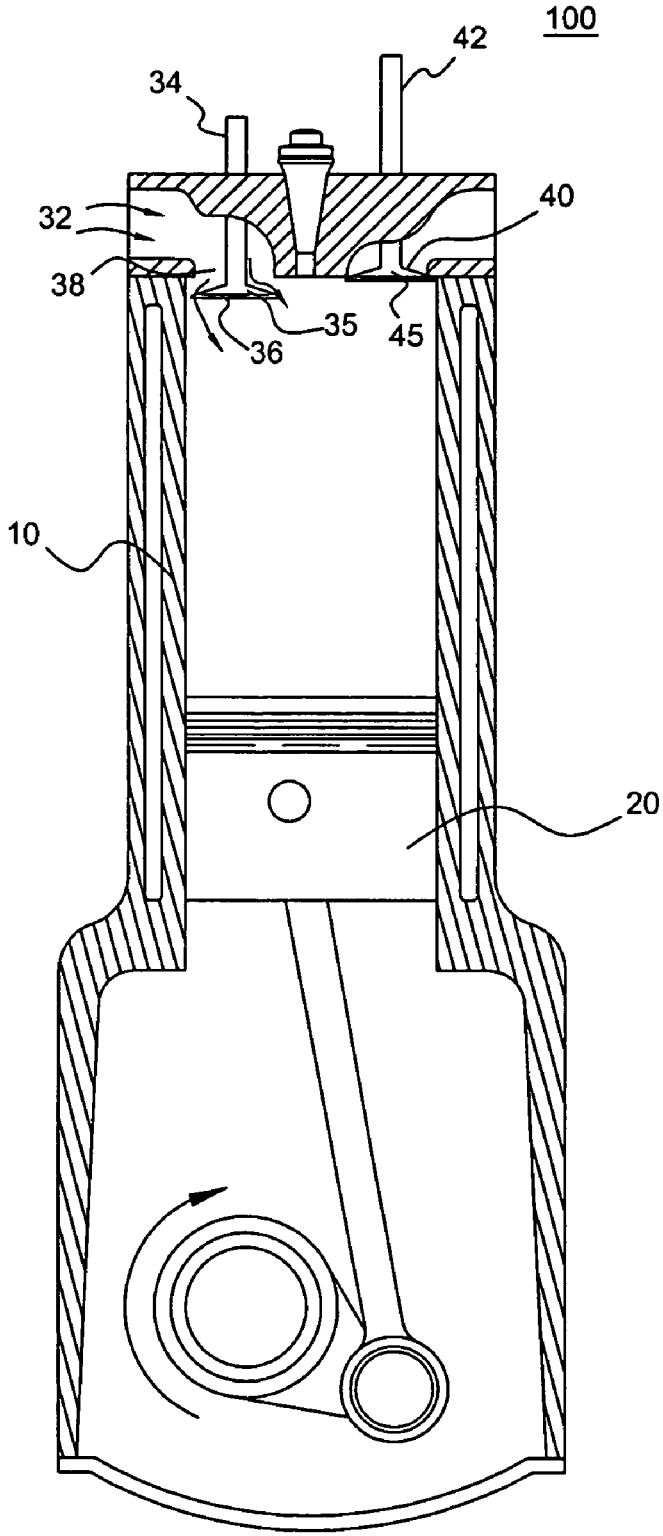
Fig. 1 Prior Art
FIG. 1 is an illustration of a common reciprocating engine with the cylinder approaching bottom center crank position during the intake stroke.
Figure 2A:
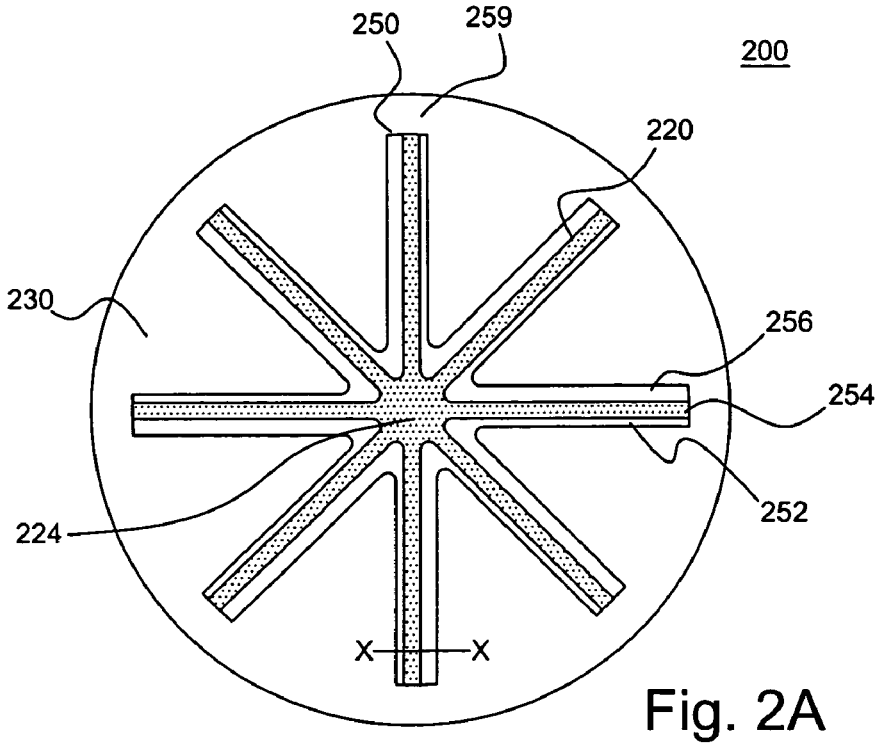
FIG. 2A is a top plan view of one embodiment of a piston of the present subject matter.
Figure 2B:
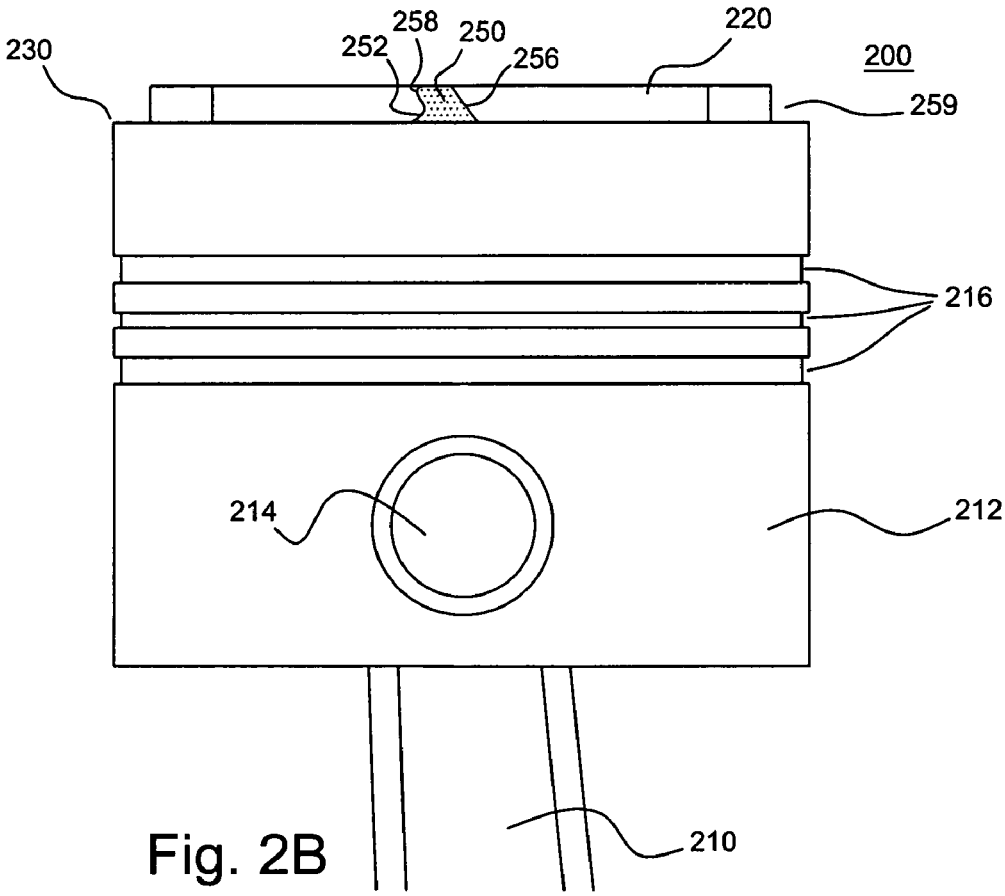
FIG. 2B is a side view of the piston of FIG. 2A.

Referring to FIG. 2, the crown 230 of a piston assembly 200 of the type illustrated in FIG. 1 is provided with a device 220. The piston assembly 200 generally comprises a connecting rod 210 operably attached to the piston body 212 via a piston pin 214. The piston body 212 generally may include ring grooves 216 extending along the circumferential periphery thereof. The position, number and depth of the ring grooves 216 are conventional.

It is to be understood that the piston and device carried by the crown thereof may be unitary in construction, i.e., the crown of the piston may be configured with the vanes of the device in any suitable conventional manner as contrasted with the construction of the device and subsequent attachment to the crown of the piston.

It is also to be understood that the devices may be embedded in or project from the top surface of the piston crown. Attachment may be by welding, high strength bolts or other suitable conventional means. The device may further comprise a connecting means such as a key, a male or female connector, or other suitable connecting means known in the art, located on the underside of the device proximate to the piston crown to thereby mate the device to the piston assembly.

The device 220 comprises a plurality of vanes 250 axially extending from the piston crown 230 and extending generally from a central portion 224 outwardly toward the periphery of the crown 230. As shown in FIG. 2A, the vanes 250 may follow a radius of the circular crown 230 as the vanes 250 extend outwardly from the central portion 224 toward the periphery of the crown 230.

Figure 6A:
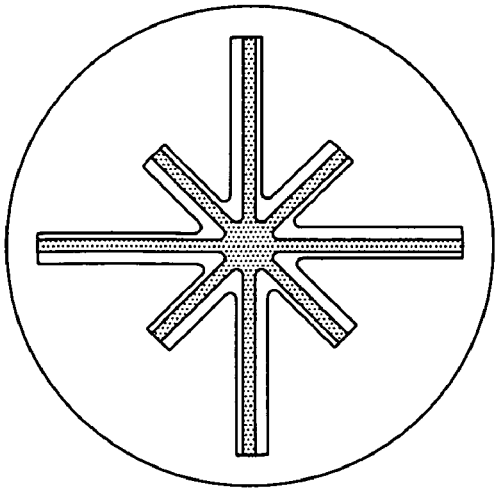
FIGS. 6A-E are top plan views of other embodiments of the device according to the present subject matter.
Figure 6C:
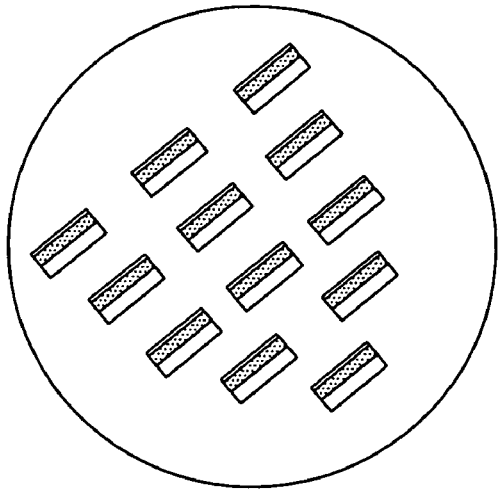
Figure 6B:
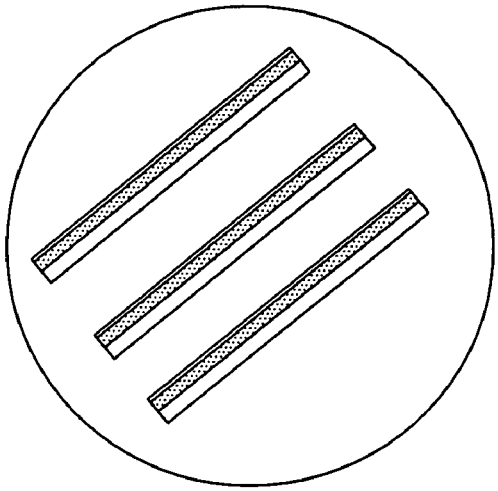
Figure 6D:
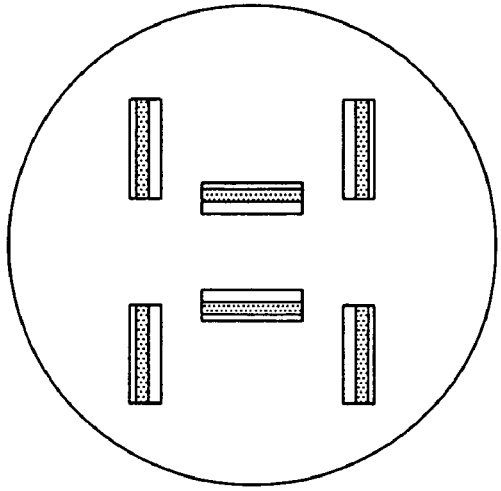
Figure 6E:
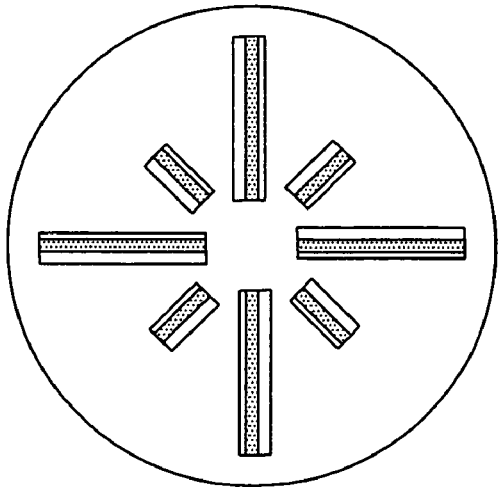

While the vanes 250 are illustrated as terminating before the circumferential edge of the crown 230 resulting in a gap 259 between the distal end of the vane and the circumferential edge of the piston crown, in alternative embodiments of the present subject matter the vanes may terminate more proximate the circumferential edge of the piston assembly 200 and/or may terminate nearer the central portion 224 resulting in gaps having various dimensions. Further, adjacent vanes 250 may also terminate at disparate distances from the circumferential edge of the crown 230 resulting in adjacent gaps having disparate dimensions. One such embodiment is illustrated in FIG. 6A. Alternative embodiments of the device 220 may include any number of vanes, e.g., two, three, four, five, six, twelve, etc., rather than the eight vanes illustrated in FIG. 2A. Additionally, the axial height and/or the length of the vanes may vary from vane to vane in a single device.

The axial movement within the cylinder of the piston assembly 200 having the device 220 affixed to the crown 230 causes pressure differentials within the cylinder thereby inducing vortices in the fuel-air mixture contained in the cylinder wherein the orientation of one or more of the vortices is more radial than axial. The orientation of one or more of the vortices may be as much as ninety degrees offset from the axis of movement of the piston, i.e., sideways within the cylinder The vortices act to increase chaotic turbulence within the fuel-air mixture thereby improving fuel burn, fuel economy, smoothness of engine operation, and driving power of the engine.

Figure 3A:
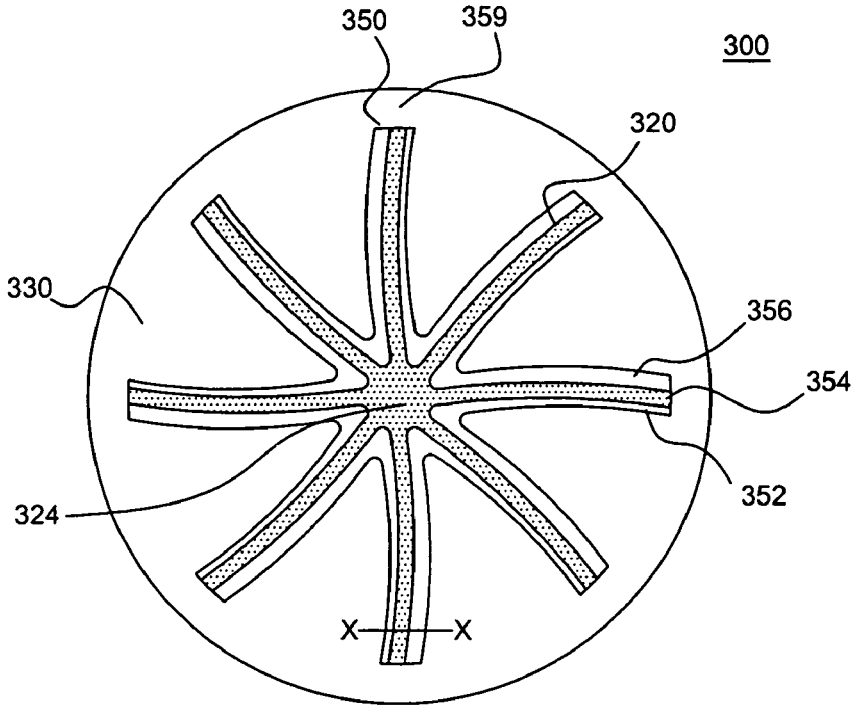
FIG. 3A is a top plan view of a second embodiment of the piston of the present subject matter.
Figure 3B:
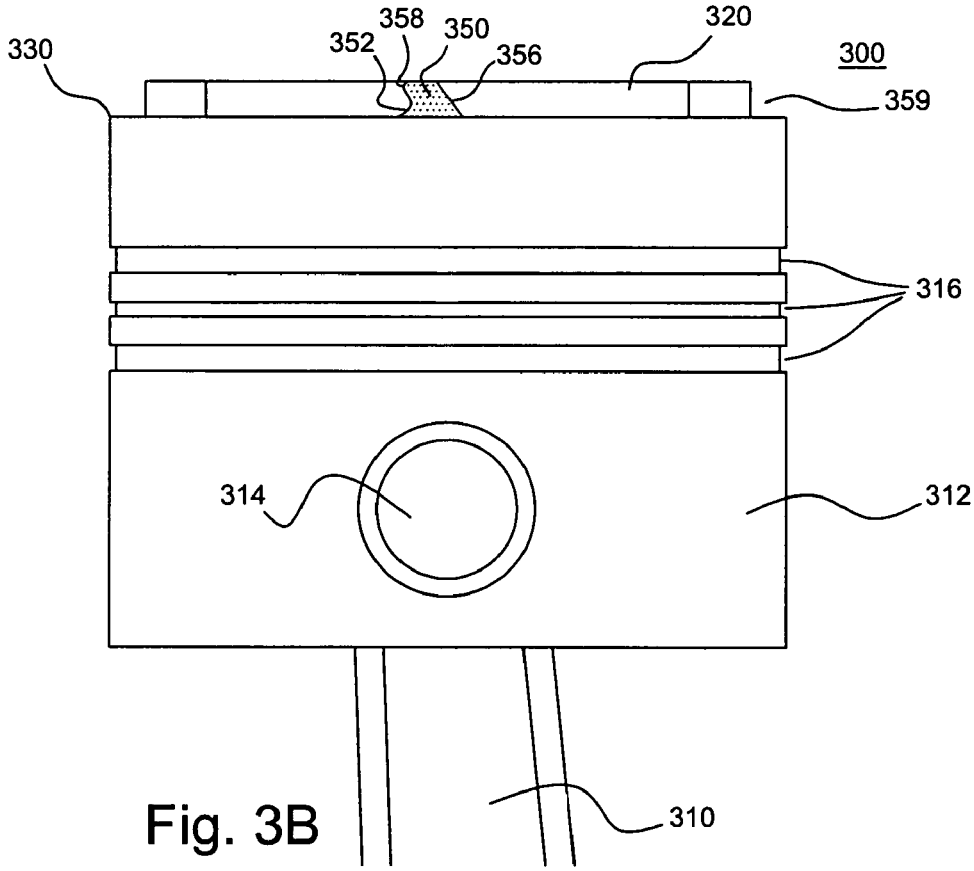
FIG. 3B is a side view of the piston of FIG. 3A.

FIGS. 3A and 3B illustrate yet another embodiment of the present subject matter where a piston assembly 300 generally comprises a connecting rod 310 operably attached to a piston body 312 via a piston pin 314. The piston body 312 may include ring grooves 316 extending along the circumferential periphery thereof and the device 320 of the present invention may be affixed to the crown 330 of the piston assembly 300. The device 320 comprises a plurality of vanes 350 axially extending from the piston crown 330 and extending generally from a central portion 324 outwardly toward the periphery of the crown 330. The vanes 350 may curve or spiral as the vanes 350 extend outwardly toward the periphery of the crown 330 and the curvature of each vane may vary from the center to the periphery and may vary from vane to vane, e.g., each vane 350 may possess the same curvature and combinations of adjacent or opposing vanes may possess the same or different curvatures. While the vanes 350 are illustrated as terminating before the circumferential edge of the crown 330 resulting in a gap 359 between the distal end of the vane and the circumferential edge of the crown, alternative embodiments may terminate the vanes 350 as described above in connection with FIG. 2.

As described above in connection with the description of the piston assembly 200 illustrated FIG. 2, the axial movement within the cylinder of the piston assembly 300 having the device 320 affixed to the crown 330 causes pressure differentials in the cylinder thereby inducing vortices in the fuel-air mixture contained in the cylinder wherein the orientation of one or more of the vortices is more radial than axial.

The spiral profile of the vanes may impart additional turbulence in the fuel-air mixture thereby enhancing the vortices and chaotic turbulence induced in the fuel-air mixture during the compression and power cycles and thus improve performance and fuel efficiency in both compression and spark ignition internal combustion engines.

Figure 4:
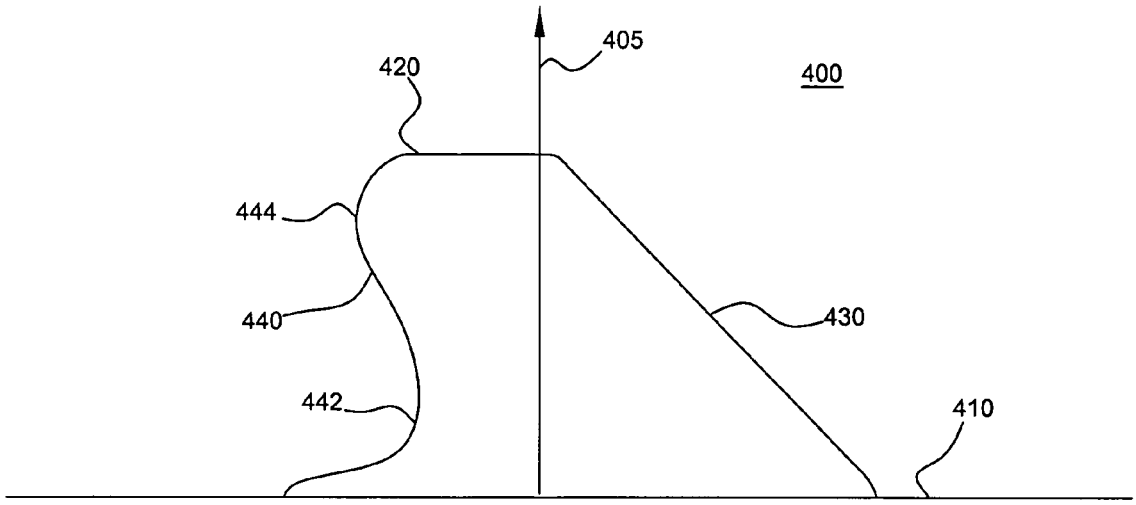
FIG. 4 is a cross-sectional illustration of one embodiment of a vane shown in FIGS. 2A and 3A.

FIG. 4 illustrates a cross-section of a vane along line X-X shown in FIGS. 2A and 3A. With reference to FIG. 4, the vane 400 comprises two walls 430, 440 axially extending from a top surface 410 of the piston 230 to a connecting surface 420 at the distal end thereof. The distance between the walls of the vane 400 is greater proximate the piston than at the distal end of the vane 400 where the walls 430, 440 are connected by the surface 420.

The slope of one wall 430 relative to the longitudinal axis 405 of the piston may be greater than the slope of the other wall 440. For the purposes of the present disclosure, the slope of a curved wall when view in cross-section is defined by a line drawn through the distal end of the wall and the intersection of the wall with the crown of the piston. As illustrated, the wall 440 may comprise a concave portion 442 proximate the crown of the piston and a convex portion 444 proximate the connecting surface 420.

Figure 5A:
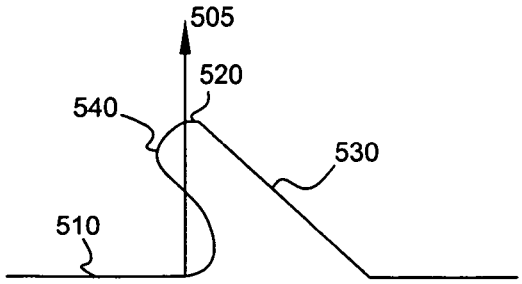
FIGS. 5A-G are illustrations of the cross-section of other embodiments of the vanes shown in FIGS. 2A and 3A.
Figure 5B:
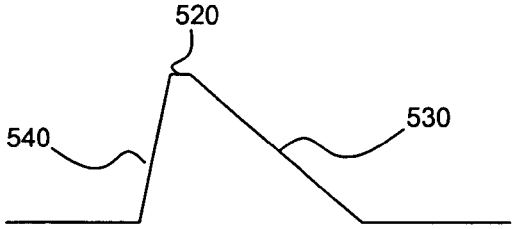
Figure 5C:
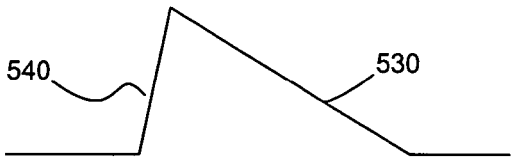
Figure 5D:
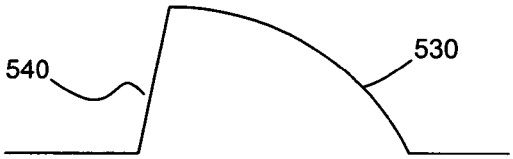

The vanes of the device according the present subject matter may include be embodied in various cross-section shapes. Some examples of other embodiments are illustrated in FIGS. 5A-G. With reference to FIG. 5A, the cross-section of a vane is illustrated having a slope of a first wall 530 relative to the longitudinal axis 505 of the piston greater than the slope of a second wall 540.

Figure 5E:
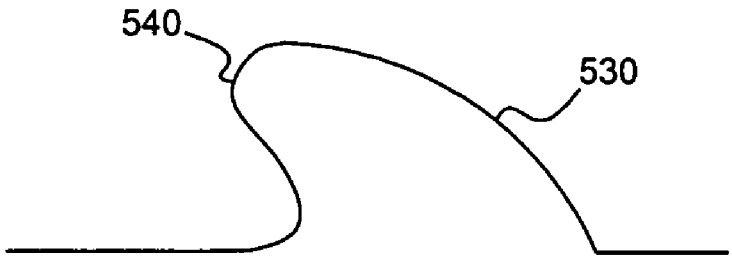

With reference to the embodiments illustrated by FIGS. 5B-5G, both walls 540, 530 of the vane may be planar (see FIGS. 5B and 5C); the first wall 530 may intersect with the second wall 540 (see FIG. 5C); the first wall 530 may be arcuate and terminate at a planar second wall 540 (see FIG. 5D); or the vane may include continuously curving walls (see FIG. 5E).

Figure 5F:
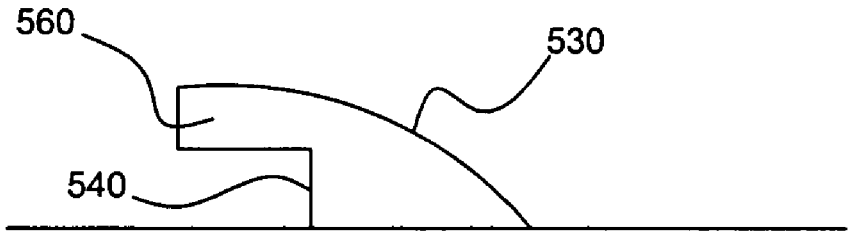
Figure 5G:
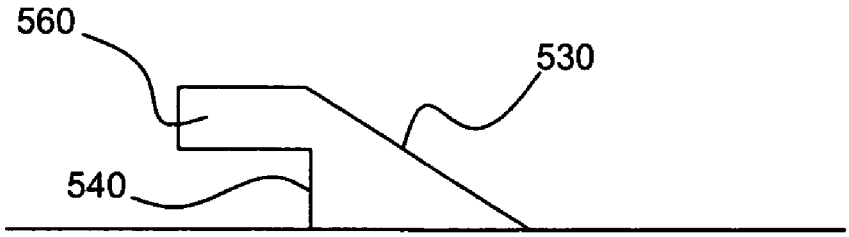

With reference to the vanes illustrated in FIGS. 5F and 5G, the cross-section of the vanes may comprise a shelf portion 560. The first wall 530 may be arcuate or planar as illustrated in FIGS. 5F and 5G, respectively.

The device according to the present disclosure may also include various arrangements of a plurality of vanes. A plurality of vanes may be positioned on the crown of the piston in any suitable manner. Some examples of possible configurations are illustrated in FIGS. 6A-E.

The axial height of the vanes may vary in accordance with the engine system in which the device is configured, with downward valve travel being one of the primary limiting factors. Also, the axial height of the vanes may vary proportionally to the height of the underlying piston. The axial which height of the vanes may be configured by design to compliment the engine involved, including the factors of combustion chamber size at the top of the compression stroke, valve throw distances, and necessary compression volume at the smallest space, being the apex of piston movement. Generally, the vane heights sought will be the largest consistent with avoidance of conflict with other structure in the engine. The axial height of the vane should be sufficient in its height from the top of the piston to minimize aerodynamic compromise by carbon accumulation, yet, due to the migratory nature of the vortices generated, even relatively small vanes, in reference to practical ranges for any given engine, will produce a beneficial effect. For purposes of illustration only, it is anticipated that in a typical small V-6 engine having a piston height of four to five inches, the axial vane height may be in a range from 5/16 inches to ¾ inches. The ratio between the shortest distance to piston top of each vane to the longest distance (lateral sloping distance) to contact with piston top may be in the range between 1:2 and 1:4, with the range further determined on the basis of the dimensions and dynamic considerations of the particular engine in which the installation is anticipated. The engine size will denominate piston size, and piston size will denominate piston crown diameter. The piston crown diameter will be among the considerations necessarily taken into account in selection of the number of and size of the vanes. Variations in the number and size of the vanes may occur between different engines due to these factors, but fuel efficiency, power efficiency (relative to unit of hydrocarbon consumed per unit of torque produced), and resulting reduction in hydrocarbon emissions is anticipated to occur in all applications.

It is an aspect of the present subject matter to increase turbulence in the fuel-air mixture through an establishment of areas of varying pressure at a plurality of regions at and near the top surface of a piston. These pressure differentials result from the relative pressure velocities of the fuel-air mixture in its interaction with the device, and particularly with the vanes thereon, during the axial movement of the piston in the combustion chamber.

As earlier indicated, these radial-vortices-creating pressure differentials may be created by a device installed, or affixed to, or embedded in a piston crown, or by configuring or forming the piston crown with suitable aerodynamic structures.

It is also an aspect of the present subject matter to induce cyclonic vortices at the outer edge of the vanes as the interaction between the fuel-air mixture and combustion gas occurs at differing velocities at a slip stream interface between the respective air flows coming from differing sides of the vanes. The cyclonic vortices propagate chaotically in the fuel-air mixture thereby resulting in an increase in turbulence and the rate of fuel saturation in the air.

While preferred embodiments of the present invention have been described, it is to be understood that the embodiments described are illustrative only and that the scope of the invention is to be defined solely by the appended claims when accorded a full range of equivalence, with many variations and modification naturally occurring to those of skill in the art from a perusal hereof.

What is claimed is:

1. An internal combustion engine having a piston reciprocatingly slidable within a combustion chamber along the sliding axis thereof (a) to compress for combustion a fluid mixture including oxygen and a combustible fuel, and (b) to provide driving power in response to the combustion of the fluid mixture within the chamber, wherein the surface of the piston in contact with the fluid mixture causes vortices in a substantial portion of the fluid mixture as the piston moves within the chamber, and wherein the orientation of one or more of the vortices created within the fluid mixture relative to the direction of movement of the piston is more lateral than axial.

2. In an internal combustion engine having a piston reciprocatingly slidable within a combustion chamber along the sliding axis thereof (a) to compress for combustion a fluid mixture including oxygen and a combustible fuel, and (b) to provide driving power in response to the combustion of the fluid mixture within the chamber, the improvement wherein the surface of the piston in contact with the fluid mixture includes a plurality of vanes extending from the piston generally axially of the chamber and extending generally from the center of the piston outwardly toward the periphery thereof, each of said vanes having two walls extending generally axially from the piston to a connecting surface at the distal end of the vanes, and the slope relative to the sliding axis of the piston of one of said walls being greater than the slope of the other of said walls.

3. The internal combustion engine of claim 2 wherein the piston is cylindrical and each of said vanes follows a radius as it extends generally outwardly toward the periphery of the piston.

4. The internal combustion engine of claim 3 wherein the length of each vane is less than the radius of the piston so that the radially distal end of each vane is spaced from the peripheral edge of the piston.

5. The internal combustion engine of claim 2 wherein each of said vanes curves as it extends generally outwardly toward the periphery of the piston.

6. The internal combustion engine of claim 5 wherein each vane has the same curvature.

7. The internal combustion engine of claim 2 comprising at least four vanes.

8. The internal combustion engine of claim 7 comprising at least six vanes.

9. The internal combustion engine of claim 8 comprising at least eight vanes.

10. The internal combustion engine of claim 2 wherein the one of said walls having the lesser slope comprises a concave portion proximate the piston.

11. The internal combustion engine of claim 10 wherein the one of said walls having the lesser slope comprises a convex portion proximate said connecting surface.

12. The internal combustion engine of claim 11 wherein the one of said walls having the greater slope comprises an arcuate portion.

13. The internal combustion engine of claim 10 wherein the one of said walls having the greater slope comprises an arcuate portion.

14. A device for attachment to the crown of a piston reciprocatingly carried in the combustion chamber of a reciprocating piston engine, said device comprising an aerodynamic structure for causing vortices in a substantial portion of the fluid contained in said chamber during reciprocation of the piston, the orientation of the vortices being more orthogonal to the axis of piston movement than parallel to the axis of piston movement.

15. The device of claim 14 wherein said aerodynamic structure comprises a central portion and a plurality of vanes extending laterally outwardly therefrom.

16. The device of claim 15 wherein each of said vanes comprises an arcuate wall extending from the crown generally axially of the piston, a second wall extending from the crown generally axially of the piston, a third wall extending substantially parallel to the crown from the distal end of said second wall, and a fourth wall extending axially from said third wall, said fourth wall connected at the distal end thereof to the distal end of said arcuate wall.

17. The device of claim 15 wherein each of said vanes comprises a first wall extending from the crown generally axially of the piston, said first wall having a substantially constant slope, a second wall extending from the crown generally axially of the piston, a connecting surface extending from the distal end of said first wall, a third wall extending substantially parallel to the crown from the distal end of said second wall, and a fourth wall extending axially from said third wall, said fourth wall connected at the distal end thereof to said connecting surface.

18. The device of claim 15 wherein each of said vanes comprises two walls extending generally axially from the crown of the piston and a connecting surface at the distal end thereof, the slope relative to the axis of movement of the piston of one wall of one or more of said vanes being greater than the slope of the other of said walls.

19. The device of claim 18 wherein the wall having the lesser slope includes a convex portion proximate the crown.

20. The device of claim 19 wherein the wall having the lesser slope includes a concave portion proximate the distal end thereof.

21. The device of claim 20 wherein the wall having the greater slope includes an arcuate portion.

22. The device of claim 18 wherein the wall having the greater slope includes a convex portion proximate the crown.

23. The device of claim 18 wherein the wall having the greater slope includes a major portion having a substantially constant slope.

24. The device of claim 18 wherein the wall having the greater slope includes an arcuate portion.

25. The device of claim 18 wherein each of said vanes follows a radius as it extends generally outwardly toward the periphery of the piston.

26. The device of claim 18 wherein each of said vanes curves as it extends generally outwardly toward the periphery of the piston.

27. The device of claim 26 wherein each vane has the same curvature.

28. The device of claim 18 wherein the length of each vane is less than the radius of the piston so that the radially distal end of each vane is spaced from the peripheral edge of the crown.

29. The device of claim 18 comprising a single vane.

30. The device of claim 18 comprising at least four vanes.

31. The device of claim 30 comprising at least six vanes.

32. The device of claim 31 comprising at least eight vanes.

33. A device for attachment to the crown of a piston in a reciprocating piston engine, said device comprising a central portion and a plurality of vanes extending outwardly from said central portion toward the periphery of the piston crown, each of said vanes comprising two walls extending from the crown in the direction of movement of the piston and a connecting surface connecting said walls at the distal ends thereof the slope relative to the direction of movement of the piston of one of said walls being greater than the slope of the other of said walls.

34. A method of generating combustion enhancing turbulence in the fluid within a combustion chamber of a reciprocating piston engine, said method comprising the step of creating vortices in a substantial portion of the fluid as the piston reciprocates through the chamber having an orientation that is more orthogonal than parallel to the reciprocating axis of the piston.

35. A method of generating combustion enhancing turbulence in the fuel mixture in the combustion chamber of a reciprocating piston internal combustion engine including the step of creating flow in the fuel air mixture by the movement of the piston, wherein a substantial portion of the flow comprises one or more vortices having an orientation more normal to the direction of movement of the piston than parallel the direction of movement of the piston.

36. The method of claim 35 wherein the direction of the flow is generally outward toward the periphery of the piston.

* * * * *